United States Patent [19]

Sano et al.

[11] Patent Number: 4,545,702

[45] Date of Patent: Oct. 8, 1985

[54] BORING-INJECTION DEVICE, METHOD FOR IMPROVING GROUND BY MEANS OF THE DEVICE AND METHOD FOR INVESTIGATING GROUND STATE BY MEANS OF THE DEVICE

[75] Inventors: Sakae Sano; Hisashi Kitajima, both of Tokyo; Hiroshi Iimori, Yokohama; Tadashi Nishio, Koganei, all of Japan

[73] Assignees: Toa Grout Kogyo Co., Ltd.; Mitsui Toatsu Chemicals, Inc.; Tonan Kaihatsu Kogyo Co., Ltd., all of Tokyo, Japan

[21] Appl. No.: 508,380

[22] Filed: Jun. 27, 1983

[30] Foreign Application Priority Data

| | | | |
|---|---|---|---|
| Jul. 2, 1982 | [JP] | Japan | 57-114046 |
| Jul. 2, 1982 | [JP] | Japan | 57-114047 |
| Dec. 6, 1982 | [JP] | Japan | 57-212743 |
| Apr. 19, 1983 | [JP] | Japan | 58-67784 |

[51] Int. Cl.[4] ..... E02D 3/12; E02D 5/18

[52] U.S. Cl. ..... 405/269; 405/266

[58] Field of Search ..... 405/233, 236, 240–242, 405/248, 258, 263, 266, 267, 269, 270; 166/187, 191, 250; 175/50, 67; 73/38, 78, 84, 85, 155

[56] References Cited

U.S. PATENT DOCUMENTS

| | | | |
|---|---|---|---|
| 3,035,440 | 5/1962 | Reed | 73/38 X |
| 3,442,122 | 5/1969 | Broise et al. | 73/84 X |
| 3,771,360 | 11/1973 | Prats | 73/155 |
| 3,949,561 | 4/1976 | Chapman | 405/266 |
| 4,031,971 | 6/1977 | Miller | 175/67 X |
| 4,302,132 | 11/1981 | Ogawa et al. | 405/269 |
| 4,309,129 | 1/1982 | Takahashi | 73/84 X |
| 4,326,409 | 4/1982 | Hughes | 73/84 |
| 4,398,416 | 8/1983 | Nolte | 73/155 |
| 4,424,859 | 1/1984 | Sims et al. | 166/187 X |

FOREIGN PATENT DOCUMENTS

| | | | |
|---|---|---|---|
| 75017 | 6/1980 | Japan | 405/269 |
| 116918 | 9/1980 | Japan | 405/269 |
| 165314 | 12/1980 | Japan | 405/269 |
| 142912 | 11/1981 | Japan | 73/38 |

*Primary Examiner*—Cornelius J. Husar
*Assistant Examiner*—Nancy J. Stodola
*Attorney, Agent, or Firm*—Jordan and Hamburg

[57] ABSTRACT

A boring-injection device comprises a fluid supplying hollow rod, a fluid discharge portion at the lower end of the rod, and a packer element inflatable from the rod to seal a space between the rod and a borehole wall at a desired depth position. The rod is surrounded by a sheath so that the packer element and fluid discharge portion can be protruded out of and retracted within the sheath in a body. They are retracted during the boring operation and protruded during injecting or investigating operation. The device can be used for practising a method of ground improvement or a method of ground investigation.

19 Claims, 14 Drawing Figures

BORING-INJECTION DEVICE, METHOD FOR IMPROVING GROUND BY MEANS OF THE DEVICE AND METHOD FOR INVESTIGATING GROUND STATE BY MEANS OF THE DEVICE

BACKGROUND OF THE INVENTION

1. Field of the Invention

The present invention relates to ground or foundation improvement such as accretion of subterranean loose earth, stabilizing incompetent ground, etc. by injection grouting, and to ground investigation. In particular, the present invention relates to a boring-injection device capable of performing ground improvement, a method for improving the ground by means of the device, and also a method for investigating the states of the ground before and after the improvement such as a method for measuring the permeability of the ground site, a method for measuring the strength of the ground site, and a method for measuring mud flush of the ground site, by means of the device.

2. Description of the Prior Art

In injecting a grouting agent for ground or foundation improvement, the so-called 1.5 shot method has been available, which comprises inserting a fluid supplying hollow rod in a borehole, pumping a grouting agent having a gelation time of 1 to 2 minutes into the rod and letting the agent discharge out at the lower end of the rod, thereby infiltrating the agent into the ground (the gelation time will be hereinafter referred to simply as "gel time"). However, the method has such a disadvantage that the agent is liable to run away along an elongated annular gap between the fluid supplying hollow rod and the borehole, so that no effective injection can be obtained. In order to overcome the disadvantage, it may be conceivable to supply a grouting agent of shorter gel time, for example, 1 to 20 seconds, thereby accelerating the gelation and preventing the run away, but the gelation starts earlier in the fluid supplying hollow rod, so that there is a fear of clogging in the rod.

In order to overcome such fear, the so-called 2-shot method has been available, which comprises using a fluid supplying double hollow rod having passages for separately supplying two kinds of grouting agents, mixing the two kinds of grouting agents at the discharge opening of the double hollow rod, thereby preparing a grouting agent mixture of flash setting, and infiltrating the agent into the ground. The runaway of the grouting agent can be substantially prevented thereby. On the other hand, the grouting agent mixture of flash setting is less infiltratable into the ground, and if it is forcedly injected into the ground, the infiltration goes vein-like and a pervaded uniform injection can hardly be obtained. Furthermore, cracks may develop in the ground due to the vein-like infiltration.

In order to solve the problem, an injection method using a grouting agent of short gel time with flash setting and a long gel time grouting agent has been developed, where a fluid supplying double hollow rod as described above is used, and at first two kinds of the grouting agents, which make the flash setting grouting agent when mixed, are supplied separately through the hollow rod inserted to a predetermined depth and mixed with each other before discharging out of the hollow rod. The mixture is discharged laterally from the rod into the annular gap between the hollow rod and borehole to form the so-called packer by the grouting agents, and then the grouting agent of long gel time is supplied through the hollow rod and injected below the packer. Thus, a grouting agent of long gel time can be injected thereby, and consequently a pervaded uniform improvement can be attained around and along the lower portion of hollow rod. However, the formation of the packer by the grouting agents is hard to adjust. Satisfactory packer effects cannot be obtained with too small a discharge amount on one hand, while vein-like infiltration occurs with too large a discharge amount on the other hand and cracks develop in the soil.

Another method capable of injecting a grouting agent of long gel time is a sleeve injection method which comprises inserting an outer pipe into a borehole after boring, filling a cement-bentonite mixture into the gap between the borehole and the outer pipe, inserting an inner pipe into the outer pipe after the curing of the cement-bentonite mixture, the inner pipe having at its lower end two disk or lamp-shade type rubber packers arranged opposedly and provided with a respective periphery in sealing contact with the inner surface of the outer pipe so as to form a tightly sealed chamber between the two packers and the inner surface of the outer pipe, making the tightly sealed chamber meet one group of discharge openings provided stagewise on the outer pipe, supplying a grouting agent into the tightly sealed chamber through the inner pipe, developing cracks in the cement-bentonite by the pressure of the grouting agent discharged from the discharge openings, and injecting the grouting agent into the ground through the cracks, where the injection step is stagewise transferred upwards or downwards to conduct ground improvement in the desired range of depth. The sleeve injection method has such disadvantages that the outer pipe remains inserted and cannot be repeatedly utilized and filling of cement-bentonite is required. Also cracks are neither surely uniformly developed in the cement-bentonite at the injection of the grouting agent, nor artificially adjusted, so that uniform injection of the grouting agent cannot be assured, and furthermore, working steps are increased with much labor.

The present invention also relates to a method for using the device as described at the beginning of the specification.

When the water permeability of soil is to be investigated with respect to the soil layer at various depths at a location to be investigated or measured, in the past, at first a boring machine or a drilling machine with a scaffold for well drilling has been set at a point to be investigated, and the ground has been bored to a desired depth with a rotary boring or impact boring device, while using a mud slurry for protecting the borehole wall from being crumbled, or while inserting an outer pipe (casing) into the borehole for protecting the borehole wall by degrees as the mud slurry boring proceeds. The outer pipe or casing usually has a diameter of 50 mm to 400 mm.

After the mud slurry boring has been carried down to the desired depth and the casing has been inserted into the borehole, a mixture of mud slurry and scrapped soil and sand (slime) filled in the casing is thoroughly replaced with clear water supplied to the casing to wash the casing inside, and is completely washed out of the casing. Then, a pump is inserted into the casing to pump up underground water accumulated in the casing to measure the water permeability of the relevant soil layer, or when there is no room for inserting the waterlifting pump into the casing, the underground water accumulated in the casing is thoroughly removed from the casing by an air lift to measure the water permeability of the soil layer from changes with time in the amount of the underground water accumulated in the casing, or otherwise clear water is introduced into the casing so that a change with time in water level in the casing from the tentatively highest level due to the introduction of the clear water down to the normal water level is observed to determine the water permeability of the soil layer.

Any of these well known methods requires a considerable time from the initial boring of ground to the final measurement with the insertion of a casing, and thus the measurement at many investigation points requires much more time, labor and cost. This means that, when a large area or a long route must be investigated, it has been only possible to make one investigation or one measurement of water permeability per area of 500 to 1,000 $m^2$ or per route of 100 m or 200 m long. This is also because much time or labor is required for preparatory works in the conventional methods for investigating the water permeability. Excessive auxiliary works are often required for compensating the scarcity of the points in which the investigation have been performed.

In order to measure or investigate the strength proper to soil at various depths at site, the standard penetration test, or the lateral load test that has been recently developed and being now gradually utilized or other various checkup tests depending upon the soil to be investigated are available.

The standard penetration test is a method comprising boring the ground to a predetermined depth by a rotary boring machine, fixing a Raymond soil sampler, 2 inches (about 5 cm) in diameter and about 80 cm long, to the lower end of a boring rod, allowing the weight of 63.5 kg as defined in the standard to fall upon the rod from a height of 75 cm by gravity to plunge the Raymond sampler fixed to the lower end of the rod into the soil to be investigated, and estimating the strength proper to the soil from the required number of hittings until the sampler has been plunged 30 cm deep into the soil (the required number of hittings is generally called "N value").

The lateral load test is a method which comprises boring the ground down to a depth to be investigated by means of a borehole crumbling-preventing pipe, 30 cm in diameter, called "casing" by a rotary boring machine, removing clear water or mud slurry used for boring from the casing after the boring down to the predetermined depth has been completed, inserting an elastomeric cylindrical tube into the casing after the clear water or mud slurry has been removed, inflating the elastomeric cylindrical tube by compressed air to attain tight sealing to the borehole wall, increasing air supply to the elastomeric cylindrical tube to increase the pressure in the tube, and determining a deformation rate of the borehole wall due to the increased pressure from the air supply rate, thereby determining the strength of the soil layer at the desired depth. The elastomeric cylindrical tube usually has an effective length of 1.0 to 2.0 m.

In these standard penetration tests and lateral load tests, boring of the ground must be carried out with the borehole crumbling-prevenging casing before the measurement, and this boring operation takes a large weight on the test work. Particularly, when the soil layer at a depth of, for example, 30 to 50 m or more is to be investigated, a casing of larger diameter must be used, and consequently it takes much time and also much labor in boring. The reliability of the investigation is lowered with increasing depth, and the investigation very often fails to offer correct data that meet the actual state.

In ground boring work using a mud slurry (slurry containing bentonite, slurry containing clay powder or raw clay, or slurry further containing other chemical compounds or natural fibers or the like), flush loss of mud slurry has a great influence upon the progress or work and quality and completion of work, irrespectively of working types.

For example, when the ground includes a layer of large water permeability or voids, the mud slurry used for the boring will continuously run away therethrough, and a considerably large amount of mud slurry as prepared will be ineffectively run away, or the borehole obtained by the boring will be crumbled by the flushing mud slurry and the large amount of flushed mud slurry contaminates the natural underground water to considerably foul the latter. That is, natural environment will be often spoiled thereby. This will be also be true in tunnel working using a mud slurry or mud.

In the operation of boring the ground using a mud slurry, a tendency of mud slurry flush loss has been so far checked up by sampling a large amount of soil at the desired depth at the site by a special means, for example, by a hammer grab, earth drill or other device, stamping the sampled soil in a laboratory and investigating the amount of mud slurry flushed from the stamped soil. In this method, the soil is sampled as disturbed, and thus is far away from the soil proper in its natural state, and only a tendency can be estimated in spite of the expensive, laborious test. There is a great difference in the results between the test directed to the artificially prepared soil and the test of the soil in the natural state. Particularly in the test directed to soil, the structure and state of soil are widely different and usually there are no two of the same structures and states. Any direct mud slurry flush loss test directed to natural soil at any depth at a site (site test) has not been established yet, and only an indirect method for estimating the flushing state from the water permeability of underground water in the ground is now available.

SUMMARY OF THE INVENTION

A first object of the present invention is to provide a grouting agent-injection device of simple structure capable of surely and uniformly injecting any type of grouting agent including the flash setting type and the long gel time type by simple operation and also capable of being repeatedly utilized without any of the aforementioned disadvantages.

A second object of the present invention is to enable water permeability investigation of a large number of soil layers within a short time without the disadvantages inherent to such conventional methods.

A third object of the present invention is to provide a method for investigating the strength of soil layers simply and economically and freely at any depth without time loss in the preparatory work as encountered in the mud slurry boring using a casing of large diameter.

A fourth object of the present invention is to provide a method for investigating and checking on the amount of flushing mud slurry directly at a site by means of a device according to the present invention.

The first object can be attained in the present invention by a boring-injection device comprising a fluid supplying hollow rod, a fluid discharge portion provided at the lower end of the rod, and a packer element inflatable from the rod to seal a space between the rod and a borehole wall at a desired depth position, characterized in that the packer element is a sleeve member inflatable by a pressurizing fluid and forms a protrusible end member together with the fluid discharge portion, that a sheath is fitted around the fluid supplying hollow rod leaving a space therebetween, that the protrusible end member can be protruded from the sheath, that the root portion of the protrusible end member is in sealingly slidable contact with the inside surface of the sheath so that a pressurizing fluid passage space is formed between the hollow rod and the sheath, the lower end of the space being bounded by the root portion of the protrusible end member, and that a passage capable of communicating the pressurizing fluid passage space with the inside surface of the packer sleeve when the protrusible end member is exposed from the lower end of the sheath is provided in the protusible end member in order to inflate the packer sleeve.

According to the device of the present invention, the packer sleeve is inflated in succession to the portrusion of the protrusible end member after the boring, and the so-called mechanical packer can surely seal the space between the borehole and the grouting agent-injection device above the position to be injected so that an effective injection of any type of grouting agent can be attained without flush loss, and also the whole operation from the boring to the injection can be carried out in succession, and also it is capable of using the device repeatedly.

According to a preferable embodiment, the passage provided in the protrusible end member is open to the the peripheral surface of the root portion of the protrusible end member on one hand, and is open to a chamber facing the back side of the packer sleeve on the other hand, and an annular recess capable of communicating the opening of the passage provided at the root portion of the protrusible end member with the pressurizing fluid passage space when the protrusible end member is exposed from the lower end of the sheath is provided at the inside peripheral surface of the sheath at the lower part. With this structure, the protrusion of the protrusible end member after boring and successive inflation of the packer sleeve can be very effectively carried out.

According to another preferable embodiment, the fluid discharge portion has several rows of a number of radial holes provided peripherally at the wall of a bottom-closing pipe provided at the extended lower part of the protrusible end member. With this structure, the grouting agent can be uniformly discharged to the periphery of the protrusible end member. It is preferable that the rows of the radial holes as peripherally provided are provided at desired distances at stages and the holes at each stage are covered each with an elastomeric sleeve. In this case, the grouting agent is discharged along the brim of the elastomeric sleeve while pushing away the elastomeric sleeve, but the closing force exerted by the elastomeric sleeve can make uniform the discharge pressure of the grouting agent passing through the holes throughout, whereby uniform discharge of grouting agent can be carried out through every hole, and uniform injection of grouting agent can be obtained in a desired range of depth. Without the elastomeric sleeve, the discharging force of the grouting agent becomes weaker through the holes located at a higher level. Furthermore, the elastomeric sleeve serves as a back-flow check means. When a plurality of the packer sleeves and the rows of the radial holes are alternately provided in succession in the device, an annular closed space defined by each pair of upper and lower packers can be provided around the protrusible end member, and the grouting agent can be uniformly infiltrated into the surrounding ground through the closed space.

According to another preferable embodiment, the protrusible end member and the fluid supplying hollow rod are connected to each other through a telescopic extensible pipe. With this structure, the sheath and the fluid supplying hollow rod can be integrally moved with respect to the protrusible end member, when the protrusible end member is protruded from the sheath, and since no longitudinal deviation occurs between the sheath and the rod, it is not necessary to take such deviation into account when the sheath and the fluid supplying hollow rod are mounted on a boring machine.

According to a still further preferable embodiment, the fluid supplying hollow rod consists of multiple pipes concentrically arranged to one another, and separate independent fluid passages are formed therebetween. With this structure, a grouting agent of short gel time, i.e. that of flash setting, can be injected. That is, two or more kinds of grouting agents can be separately supplied through the fluid supplying hollow rod of such multiple pipes, and mixed together just before the fluid discharge portion to prepare and inject a mixture of grouting agent of flash setting.

The method for ground improvement by means of the device according to the present invention is characterized by supplying boring water to the fluid supplying hollow rod in a state of the protrusible end member being retained within the sheath, rotating the device while discharging the boring water from the fluid discharge portion, thereby boring the ground down to a predetermined depth with a bit provided at the lower end of the sheath, ceasing the boring operation, then introducing a pressurizing fluid into the pressurizing fluid passage space, thereby keeping the protrusible end member in a pushed-down state, pulling up the sheath while leaving the end member in that state, thereby protruding the protrusible end member, simultaneously supplying a pressurizing fluid to the packer sleeve, thereby inflating the packer sleeve and allowing the packer to act upon the borehole wall around the protrusible end member, then introducing a grouting agent into the fluid supplying hollow rod and discharging the grouting agent from the fluid discharge opening into the sealed space formed by the packer, thereby injecting the grouting agent into the ground.

BRIEF DESCRIPTION OF THE DRAWINGS

The above and other objects as well as various advantages of the invention will be more clearly appreciated by studying the following detailed explanation to be made with reference to the accompanying drawings, in which.

DESCRIPTION OF THE PREFERRED EMBODIMENTS

Figure 1:
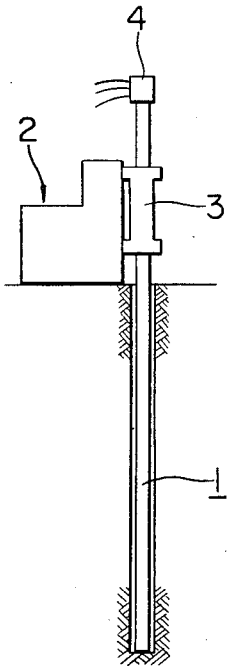
FIG. 1 is a schematic view showing a state of boring down to a desired depth by the present device set to a boring machine.
Figure 2:
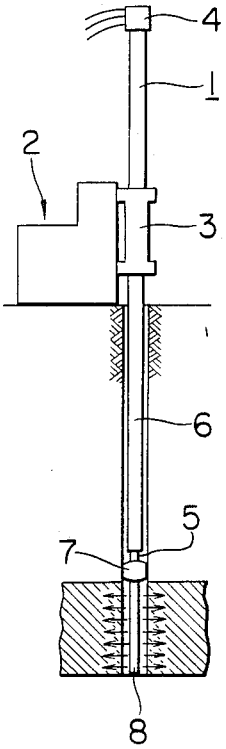
FIG. 2 is a schematic view showing a state of injecting a grouting agent while a protrusible end member is exposed.

FIGS. 1 and 2 show processes of boring and successive injection of a grouting agent or ground investigation with the present device, where numeral 1 is a boring-injection device according to the present invention, 2 is a boring machine, 3 is a device for rotating or vertically moving the boring-injection device and 4 is a swivel for introducing boring water, a pressurizing fluid, a grouting agent, etc. into the device, the swivel being fixed at the upper end of the boring-injection device.

In the boring operation, the device 1 is rotated and given a pushdown force by the boring machine 2, and boring water is supplied into the device 1 through the swivel 4 and discharges from the lower end of the device. At the lower end of the device, a bit for scraping the soil is provided (not shown in the drawings). The scraped soil is mixed with the boring water to make slime, and some of the slime is infiltrated into the ground, while the other slime is sent back to the ground surface along the outer periphery of device 1. After boring has been effected to a predetermined depth, only a sheath 6 is pulled up to expose a protrusible end member 5 as shown in FIG. 2, for example, when a grouting agent is to be injected to make ground improvement, or the entire device is slightly pulled up, and then the protrusible end member 5 is pushed out of the sheath 6. Then, a packer sleeve 7 is inflated by a pressurizing fluid supplied into the device 1, and then a grouting agent is supplied through the swivel 4 and discharged from a fluid discharge portion 8 as shown by the arrows to be injected into the ground.

Also in ground investigation with the device, boring, successive exposure of the protrusible end member and inflation of the packer sleeve are carried out in the same manner as above.

Figure 3:
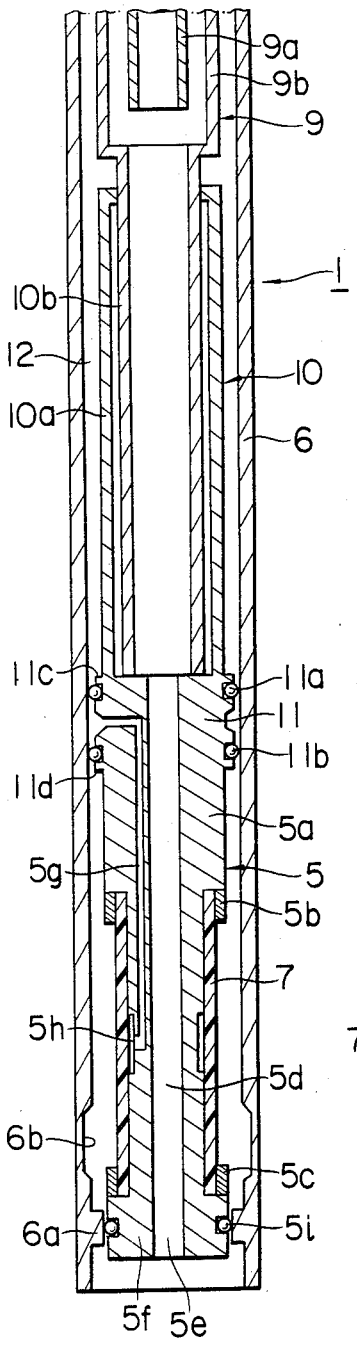
FIG. 3 is a vertical cross-sectional view of the essential part according to a first embodiment of the present device.

FIG. 3 shows one embodiment of the device 1, where numeral 9 is a fluid supplying hollow rod made from a string of tubes and the rod 9 is connected to the protrusible end member 5 through a connecting part 10. The protrusible end member 5 has a cylindrical body 5*a*, an elastomeric packer sleeve 7 fitted on an annular recess around the body 5*a* and secured at the upper and lower ends by fixing rings 5*b* and 5*c*, and a fluid discharge portion 5*f* having a discharge opening 5*e* open to the lower end of axial through hole 5*d*. A piston member 11 is provided at the upper end of the protrusible end member 5.

Figure 13:
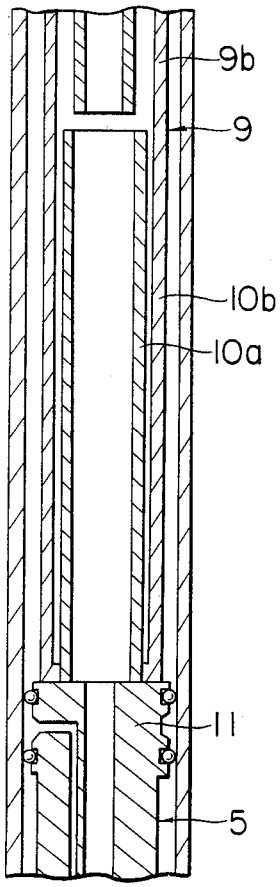
FIG. 13 is a vertical cross-sectional view showing an embodiment of a connecting part between the protrusible end member and the fluid supplying hollow rod.
Figure 14:
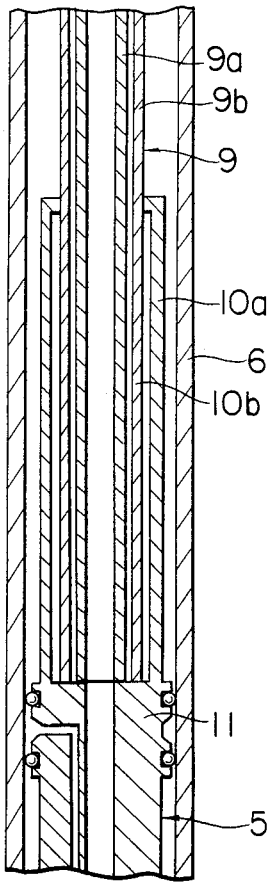
FIG. 14 is a vertical cross-sectional view showing another embodiment of the connecting part.

The connecting part 10 that connects the piston member 11 to the fluid supplying hollow rod 9 comprises an upward pipe 10*a* that is extensible upwards from the piston member 11 and a down pipe 10*b* that is extensible downwards from the rod 9. These two pipes form a telescoping joint in a fluid-tight slidable manner. The connecting part or telescoping joint 10 can also be constructed as shown in FIGS. 13 and 14.

The rod 9 is shown in FIG. 3 as a double pipe consisting of an inner pipe 9*a* and an outer pipe 9*b*, but it can also be a single pipe, or a multiple pipe such as a triple pipe, etc. with a plurality of fluid passages therein to separately supply more than two kinds of grouting agents, depending upon the kinds of grouting agents to be supplied.

The rod 9 and the protrusible end member 5 are inserted in the sheath 6. A pair of upper and lower spaced seal rings 11*a* and 11*b* are provided around the piston member 11 and between the piston member 11 and the sheath 6, whereby a closed annular space 12 is be formed above the piston member between the rod 9 and the sheath 6. The closed space 12 is communicated with pressurizing fluid (air, oil, etc.) or sometimes a negative pressure through the swivel 4.

At the upper end of the piston member 11, a shoulder part 11*c* receives a push-down force from the pressurizing fluid in the closed space 12 and at the lower end of the piston member 11 then is also formed a jaw part 11*d* that is engageable with annular projection 6*a* provided at the inside periphery of the sheath at the lower part thereof when the protrusible end member 5 is protruded from the sheath 5. A pressurizing fluid passage 5*g* opens to between the seal rings 11*a* and 11*b* of the piston member 11, and the other end of the passage is open to a chamber 5*h* provided at the back side of the packer sleeve 7.

Figure 4:
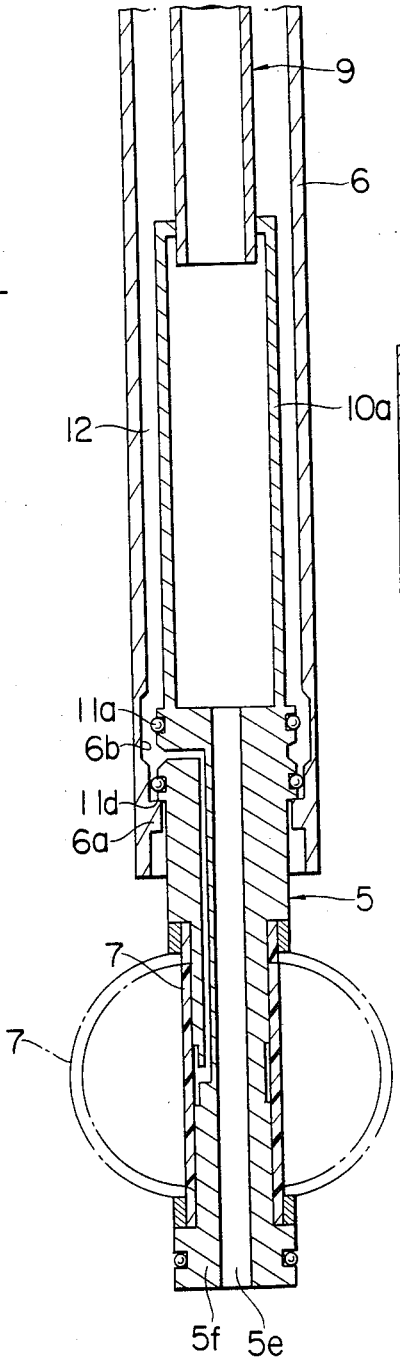
FIG. 4 is a vertical cross-sectional view showing a state of the protrusible end member being exposed in the device of FIG. 3.

An annular recess 6*b* is formed slightly above the annular projection 6*a* provided at the inside periphery of sheath 6 at the lower part, and can act to communicate the closed space 12 with the pressurizing fluid passage 5*g* when the protrusible end member 5 is protruded from the sheath 6 (see FIG. 4).

The annular projection 6*a* of sheath 6 contacts a seal ring 5*i* provided at the outside periphery of body 5*a* at the lower part of the protrusible end member to prevent the mud slurry, etc. from intake into the clearance around the packer sleeve 7. The seal ring 5*i* can be provided at the side of annular projection 6*a*.

Figure 5:
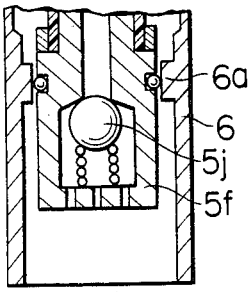
FIG. 5 is a vertical, partly cut-away view showing a modification of the fluid discharge portion in the device shown in FIGS. 3 and 4.

In order to prevent backflow of the mud slurry from the discharge opening 5*e* of protrusible end member 5, a check valve 5*j* can be provided at the discharge opening as shown in FIG. 5.

The device according to the first embodiment as described above functions as follows, when used, for example, to improve the ground.

In the device 1 set to an appropriate boring machine 2, the protrusible end member 5 is retracted in the sheath 6 at boring as shown in FIG. 3. Boring water is supplied to the fluid supplying hollow rod 9 in that state, and at the same time the device is rotated. The boring water is discharged out of the discharge opening 5*e* through the rod 9 and the through hole 5*d* of protrusible end member 5, and conveys the soil scraped by a bit (not shown) fixed to the lower end of sheath 6 along the sheath. When the closed space 12 is brought under a negative pressure during boring, an accidental projection of protrusible end member 5 due to vibration, etc. can be prevented. Since the packer sleeve 7 is retracted in the sheath 6 during boring, it can be protected from damage due to friction, etc.

After the boring has been carried out to the desired depth, a grouting agent is to be introduced therein, but before the introduction a pressurizing fluid is supplied to the closed space 12 to act upon the shoulder part 11*c* of piston member 11 and push down the protrusible end member 5. Then, the sheath 6 is pulled upwards from the state to the position shown in FIG. 4. The sheath 6 can be pulled upwards together with the rod 9, and no deviation will occur between the sheath 6 and the rod 9 at the fixing part of the boring machine. As soon as the sheath 6 reaches the position shown in FIG. 4 and the jaw part 11*d* of piston member 11 engages with the upper side of annular projection 6*a* of the sheath, the seal ring 11*a* is released in the annular recess 6*b* to communicate the closed space 12 with the pressurizing fluid passage 5*g* to pass the pressurizing fluid to the back side of packer sleeve 7 and inflate the packer sleeve. It can be checked up on the ground surface whether the packer sleeve has been inflated as desired or not. That is, inflation of packer sleeve correspondingly expands the volume of space filled with the pressurizing fluid, which is indicated by a change in pressure. By reading the change in pressure by a pressure detector on the ground surface, the inflation of packer sleeve can be determined. The degree of inflation of packer sleeve can be set as desired in view of the state of ground and grouting agent injection.

After the packer sleeve has been inflated to completely shut the runaway passage of the grouting agent as described above, the grouting agent is introduced into the rod 9 and discharges from the discharge opening 5*e* to infiltrate into the ground. Owing to the satisfactory working of such a mechanical packer, the grouting agent can be thoroughly infiltrated into the desired ground. Any grouting agent of long gel time and that of flash setting can be used. A grouting agent of long gel time can be used with the rod 9 being a single pipe. Even with a grouting agent of long gel time, it is sometimes preferable to use a rod 9, for example, of double pipe to separately supply the main agent (for example, water glass solution) and a hardening agent (for example, a strong alkali) through individual passages. They are joined and mixed together in or just before the connecting part 10 and the mixture is discharged from the discharge opening 5*e*. In preparing a grouting agent of flash setting, a multiple pipe as mentioned above is used.

After the end of injection, the closed space 12 is subjected to pressure reduction, and the packer sleeve 7 is deflated by its proper elasticity and returned to the initial state. Sometimes the closed space 12 may be brought under a negative pressure to provide forced deflation of the packer sleeve. Then, the entire device is stepped up while the protrusible end member 5 is protruded, and the inflation of packer sleeve and injection are carried out in the same manner as above. By their repetitions over the necessary stages, injection of grouting agent, that is, ground improvement can be attained in the desired depth range. In place of injection by stepping up, the injection of grouting agent can be carried out while conducting the boring.

Figure 6:
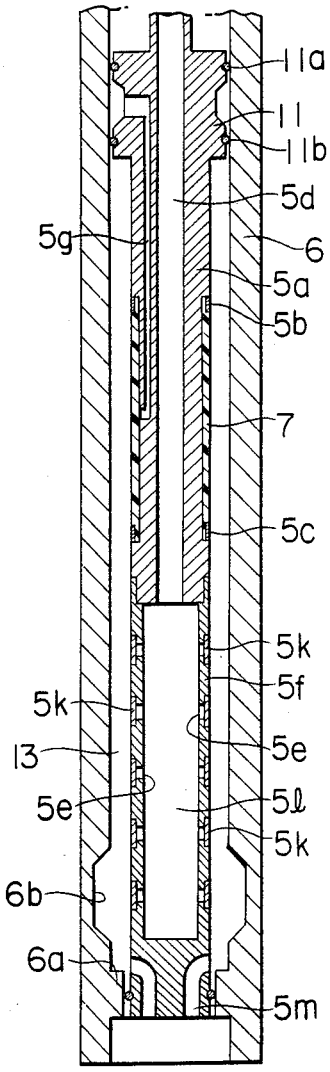
FIG. 6 is a vertical cross-sectional view showing the essential parts according to a second embodiment of the present device.
Figure 7:
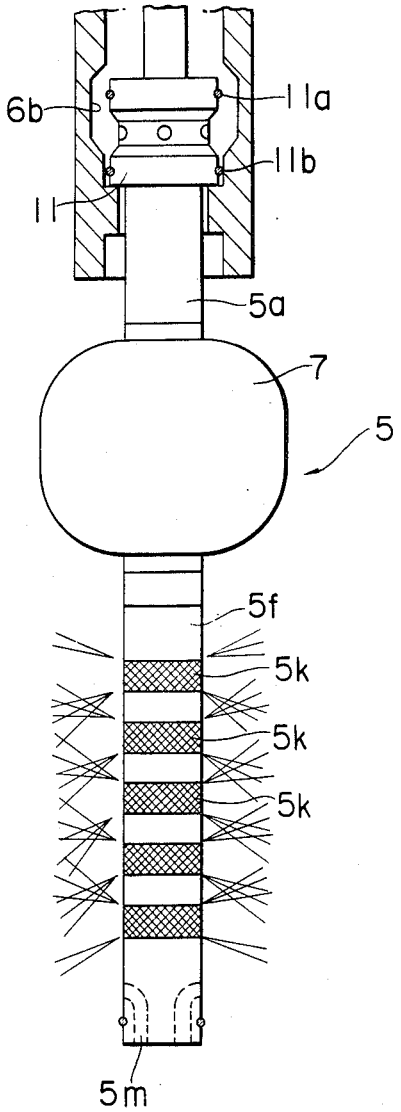
FIG. 7 is a vertical cross-sectional view showing a state of the protrusible end member being exposed in the device of FIG. 6.

FIGS. 6 and 7 show another embodiment of the present invention, where the structure of fluid discharge portion 5*f* is different from that of the first embodiment. According to the second embodiment, the fluid discharge portion 5*f* comprises a bottom-closed pipe provided at the downward extension of the protrusible end member. The pipe has a large number of radial discharge openings 5*e*. The discharge openings 5*e* are arranged at desired distances over stages in the vertical direction, and each stage of openings 5*e* is covered by an elastomeric sleeve 5*k*.

During the boring, boring water supplied through the through hole 5*d* in the state shown in FIG. 6 fills a chamber 51 in the pipe 5*f* and then passes through the discharge openings 5*e* while pushing off the elastomeric sleeves 5*k* and enters into a space 13 between the pipe 5*f* and the sheath 6 along the brims of the elastomeric sleeves 5*k*. The boring water is discharged from boring water discharge openings 5*m* provided at the lower end of pipe 5*f*.

At the injection of grouting agent, the grouting agent supplied through the through hole 5*d* in the state as shown in FIG. 7 fills the chamber 51 and is discharged along the brims of the elastomeric sleeves while pushing away the sleeves 5*k* in the same manner as with the boring water. As already described before, the closing force of the elastomeric sleeves acts to make uniform the discharge pressure of the grouting agent through every discharge openings, whereby uniform discharge of grouting agent can be attained through every discharge opening. Without the elastomeric sleeves 5*k*, the discharging force of the grouting agent becomes weaker at a discharge opening 5*e* at a higher level.

Figure 8:
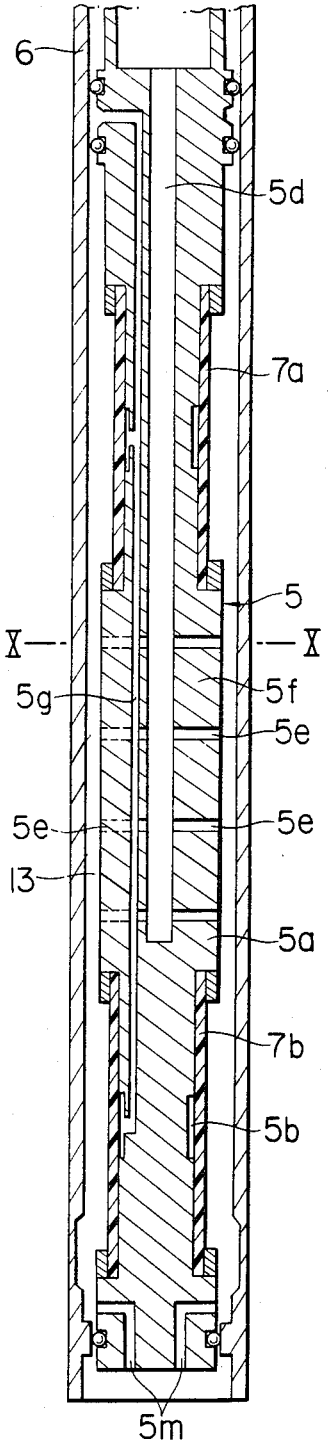
FIG. 8 is a vertical cross-sectional view showing the essential parts according to a third embodiment of the present device.
Figure 9:
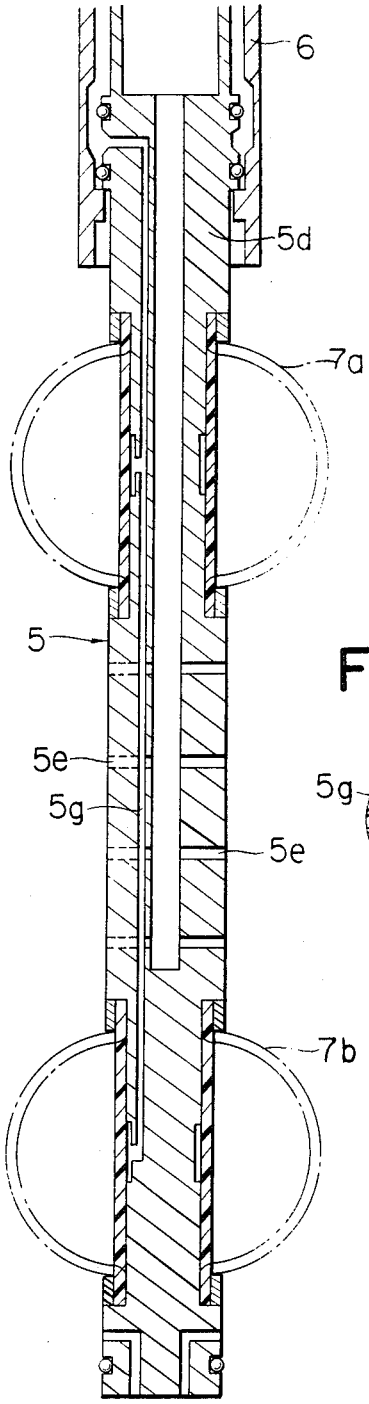
FIG. 9 is a vertical cross-sectional view showing a state of the protrusible end member being exposed in the device of FIG. 8.
Figure 10:
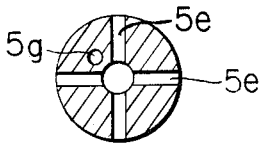
FIG. 10 is a vertical cross-sectional view along the line X—X in FIG. 8.

FIGS. 8 and 9 show still a further embodiment of the present invention, where the protrusible end member 5 has two packer sleever 7*a* and 7*b* provided vertically at a distance from each other and a fluid discharge portion 5*f* having discharge openings 5*e* radially extending from the through hole 5*d* between the upper and lower packer sleeves 7*a* and 7*b*. These are the differences from the structure of the first embodiment. The packer sleeves 7*a* and 7*b* are inflated in the same manner as in the first embodiment. As shown in FIG. 8, boring water passes through the through hole 5*d* and then through the discharge openings 5*e* into the sheath 6, and flows down through the space 13, and it is discharged through discharge openings 5*m* provided at the lower end of body 5*a* of the protrusible end member.

Figure 11:
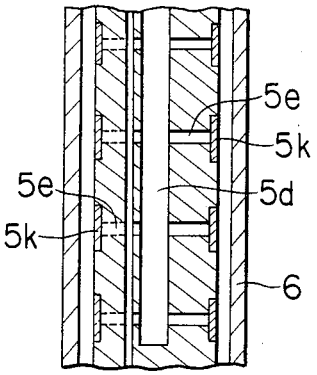
FIG. 11 is a vertical cross-sectional view showing a modification of the fluid discharge portion in the device shown in FIGS. 8 and 9.
Figure 12:
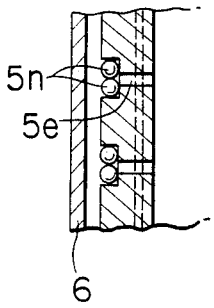
FIG. 12 is a vertical cross-sectional view showing another modification of the fluid discharge portion.

FIG. 11 shows that elastomeric sleeves 5*k* similar to those in FIG. 6 are applied to the device of FIG. 8. In place of the elastomeric sleeves, two seal rings 5*n* can be provided in contact with each other in the annular recess provided at the position of discharge opening 5*e* as shown in FIG. 12.

In this embodiment, the grouting agent injection zone can be completely controlled by the two upper and lower packers, so that more effective injection of grouting agent can be carried out. Three or more packer sleeves can be provided in the similar manner, if necessary.

Inventions of methods for using the boring-injection device will be described below, referring to the examples.

Method for measuring water permeability of a ground site:

Boring to a desired depth and successive inflation of the packer sleeve are carried out in the same manner as described above.

After the inflation of the packer sleeve, clear water is introduced into the fluid supplying the hollow rod 9 at a rate of 0.001 liter/min to 20 liter/min, and the water permeability of the soil layer is calculated from changes with time in the amount of supplied water and the pressure of supplied water. After the completion of measurement of the water permeability at the desired depth, the fluid pressure (air pressure or liquid pressure) exerted on the packer sleeve is released, whereby the packer sleever 7 is deflated and returned to the initial state. Simultaneously with the deflation of the packer sleeve, the sheath 6 is moved downwards, whereby the protrusible end member 5 is automatically retracted into the sheath 6. After the retraction, reboring can be carried out by rotating the present device. These operations can be carried out automatically and continuously by releasing the air pressure or liquid pressure in the packer without any time loss. That is, many runs of permeability test can be made in a short time and also in a wide area, so that the soil characteristics can be easily and thoroughly obtained. According to the present method, neither outer pipe called "casing" nor boring mud slurry is used at all in contrast to the conventional working process. The protrusible end member for the test is retracted in the sleeve 6, 45–50 mm in diameter, and rotary boring only with clear water can be carried out down to a soil layer at the desired depth by means of the ordinary boring machine. That is, boring down to the desired depth can be carried out very rapidly, for example with a few to several tens of minutes. Since no mud slurry is used at all, washing for mud slurry is not necessary after the boring.

Method for measuring strength of a ground site:

According to a first embodiment of the method, boring down to the desired depth, protrusion of the protrusible end member and inflation of the packer sleeve are carried out with the boring-injection device in the same manner as above, and then a highly viscous liquid is introduced into the fluid supplying hollow rod 9 and discharged into the space below the packer sleeve or between the two packer sleeves as shown in FIGS. 8 and 9 through the discharge opening 5*e*. A highly viscous liquid having no substantial infiltrability to the surrounding soil is selected. For example, water glass having a specific gravity of 1.4 (20° C.), the visocity of 120 cps (20°) and pH of 12 can be used for sand ground. The highly viscous liquid fills the space below the packer sleeve and the amount of the introduced liquid is measured under the predetermined pressure upon the liquid to determine the strength of the ground site.

According to a second embodiment of the method for measuring the strength, a boring-injection device with the packer sleeve having an effective length of 20 cm to 1.5 m is used. Boring down to the desired depth, protrusion of the protrusible end member and inflation of the packer sleeve are carried out in the same manner as described above, but compressed air or water, or equivalent liquid is introduced into the packer sleeve to inflate the packer sleeve over the entire length of 20 cm to 1.5 m and bring the packer sleeve tightly into contact with the borehole wall. The length of packer sleeve depends upon the conditions, states, etc. of soil to be investigated. For soil of relatively hard quality, for example, the N value by the standard penetration test being more than 40 ($N<40$), a packer sleeve having a length of 20 cm to 75 cm is satisfactory. For soil of low N value, for example, $N\geqq 20$, a packer having a length of 1.5 m can make measurements with less error. That is, correct measurement can be made.

After the packer sleeve has been inflated to tightly contact the borehole wall, the strength of the soil can be measured. That is, a liquid pressure or air pressure is applied stagewise to the packer sleeve tightly contacting the the borehole wall through a pressure gage, and the strength of the soil is determined from changes with time in the amount of supplied pressurizing fluid and the applied pressure, where the amount of supplied fluid is controlled to keep the applied pressure at the predetermined one for each stage.

Thus, according to this method, the strength of the soil can be easily and economically measured in the required runs at desired locations in a wide area or in a very long route as in tunnel working, and also the required runs of investigation can be carried out in the depth direction at desired locations.

Method for measuring flush loss of mud slurry in a ground site:

Boring down to the desired depth, protrusion of the protrusible end member and inflation of the packer sleeve are carried out in the same manner as described above with the said boring-injection device, and then a mud slurry adjusted in advance is introduced into the fluid supplying hollow rod 9 and discharged into the space below the packer sleeve or between the packer sleeves shown in FIGS. 8 and 9 through the discharge opening 5*e*. The mud slurry is a mixture of bentonite and water, or a mixture of clay and water or the mixture further contains fibrous additives. The pressure exerted upon the supplied mud slurry is, for example, gravity water head $+0.2$–$0.5$ kg/cm$^2$ and the supply rate of water is 0.001 liter/min to 40 liter/min. By recording the discharge rate and the pressure by an automatic recorder, the flush loss of mud slurry can be determined. By using mud slurries of varied compositions, tests can be repeated to obtain an exact determination of the mud slurry flush loss.

According to the present method for measuring flush loss of mud slurry, flush loss of mud slurry can be carried out as desired at any depth and at any location, and thus a mud slurry with no flush loss can be prepared in advance. The present method is useful also from the viewpoint of environmental safety.

Any of the previously described methods can be carried out before the injection of grouting agent (before ground improvement) or after the injection.

We claim:

1. In a boring-injection device comprising:

a fluid supplying hollow rod;

a sheath disposed coaxially around said fluid supplying hollow rod so as to be movable relative to one another in an axial direction;

an end tube arranged to be protrusible beyond and retractable within the end portion of the sheath, said end tube being in communication with the fluid supplying hollow rod and being provided with at least one fluid discharge port for discharging a fluid supplied through the fluid supplying hollow rod, and a packer element fitted around the end tube so as to be inflatable by a pressurized fluid;

an annular pressurized fluid passage space arranged between the fluid supplying hollow rod and the sheath, the forward end of the annular space being defined by an end face of a piston member formed on the end tube and adapted to slide on the inner peripheral surface of the sheath, whereby the pressurized fluid introduced into said annular passage space acts to urge the piston member and the end tube toward a direction to which the end tube is protruded; and a passage formed in the end tube to communicate said annular passage space with the packer element and inflate the latter by the supplied pressurized fluid just after the end tube is completely protruded from the sheath.

2. In a boring-injection device according to claim 1, wherein said passage in said end tube has an opening in the peripheral surface thereof, said passage in said end tube also being open to a chamber in said end tube facing the back side of said packer element, and an annular recess at the inside surface of said sheath capable of communicating said opening of said passage with the pressurizing fluid passage space when said end tube is extended from the lower end of said sheath.

3. In a boring-injection device according to claim 1, wherein said at least one fluid discharge port comprises a plurality of rows of radial holes provided in the wall of a bottom portion of said end tube.

4. In a boring-injection device according to claim 3, wherein said rows of radial holes are provided at desired distances at stages and the holes at each stage are covered each with an elastomeric sleeve.

5. In a boring-injection device according to claim 3, wherein a plurality of packer sleeves and rows of radial holes are alternately provided in succession, said passage being open to the back side of each of said packer sleeves.

6. In a boring-injection device according to claim 1, wherein said end tube and said fluid supplying hollow rod are connected to each other through a telescopic slidable pipe.

7. In a boring-injection device according to claim 1, wherein said fluid supplying hollow rod comprises multiple pipes, and separate independent fluid passages are formed between each of said pipes.

8. In a boring-injection device comprising a fluid supplying hollow rod, a sheath disposed coaxially around said hollow rod so as to be movable relative to one another in the axial direction, said hollow rod and said sheath being arranged to define an annular pressure fluid passage space between said hollow rod and said sheath, an end tube on the end of said hollow rod and having discharge means for discharging a fluid supplied through said hollow rod, said end tube being axially movable between a retracted position disposed within said sheath and an extended portion extending at least partially beyond the end of said sheath, said end tube having an upper end portion forming a piston which is slidable on the inner surface of said sheath as said end tube moves axially in said sheath, said piston being disposed relative to said passage space such that the pressure of the fluid in said passage space acts on said piston to effect extension of said end member from its retracted to its extended position, an inflatable packer means disposed about at least a portion of said end tube, a passageway in said end tube, said passageway having an end opening located below said piston, said passageway extending between said end opening and said packer means, and recess means on said sheath operable to provide fluid communication between said passage space and said passageway when said end tube is in said extended position, whereby application of pressurized fluid in said passage space acts on said piston to extend said end tube from said retracted to said extended position and upon reaching said extended position, said recess means provides said fluid communication between said passage space and said passageway to thereby inflate said inflatable packer means when said end tube reaches its extended position.

9. In a boring-injection device according to claim 8, wherein said recess means comprises a recess on the inner surface of said sheath, said recess having a diameter greater than the diameter of said piston to thereby provide for fluid passage between said recess and said piston when said end tube is in said extended position.

10. In a boring-injection device according to claim 8 further comprising seal means on said end tube which is sealingly slidable on the inner surface of said sheath, said seal means being disposed below said piston and below said end opening of said passageway such that said end opening is disposed between said piston and said seal means.

11. In a boring-injection device according to claim 8, wherein said end tube has an outer diameter less than the inner diameter of said sheath to define an annular space between said end tube and said sheath, and a seal means on an end portion of said end tube which seals with the inside of said sheath when said end tube is in said retracted position to prevent communication between the outer end of said sheath and the last said annular space.

12. In a boring-injection device according to claim 8, wherein said end tube is axially slidably mounted in said hollow rod.

13. In a boring-injection device according to claim 8 further comprising a check valve on said discharge means of said end tube.

14. In a boring-injection device according to claim 11, wherein said discharge means comprises a plurality of spaced discharge openings in the cylindrical wall of said end tube, and elastomeric means disposed about said discharge openings, said discharge means further comprising end discharge ports such that fluid flows through said discharge openings upon expanding said elastomeric means into said annular space between said end tube and said sheath for discharge through said end discharge ports.

15. In a boring-injection device according to claim 8 further comprising a plurality of inflatable packer means disposed on said end tube, said inflatable packer means being spaced from one another.

16. In a boring-injection device according to claim 15, wherein said discharge means discharges fluid between said inflatable packer means.

17. A method for injecting a grouting agent for ground improvement using a boring-injection device having a fluid supplying hollow rod disposed coaxially in a sheath with an end tube being disposed on the end of the hollow rod and movable axially between a retracted position disposed within said sheath and an extended position extending at least partially beyond the end of said sheath, said end tube having a fluid discharge means for discharging fluid supplied through said hollow rod, said end tube also having an inflatable packer means disposed thereon, the method comprising the steps of supplying boring water to said fluid supplying hollow rod while maintaining said end tube in said sheath in said retracted position, rotating the device while discharging said boring water from said fluid discharge means thereby boring the earth to a predetermined depth with a bit provided at the end of said sheath, introducing a pressurizing fluid into a pressurizing fluid passage space between said sheath and said hollow rod, causing the pressure of the pressurizing fluid in said passage space to act on said end tube to urge the latter in a downward direction, moving the sheath in an upward direction while said end tube is urged in said downward direction to thereby cause said tube to extend beyond the end of said sheath to said extended position, communicating said pressurized fluid in said passage space with said inflatable packer means to inflate the latter when said end tube reaches its extended position, expanding said inflatable packer means to engage the bore hole wall around said extended end tube, introducing a grouting agent into said fluid supplying hollow rod, and discharging the grouting agent through said fluid discharging means into the sealed space defined by the expanded packer means, thereby injecting the grouting agent into the ground.

18. A method according to claim 17, wherein the fluid supplying hollow rod comprises a plurality of pipes disposed within one another such that separate independent fluid passage spaces are formed between the plurality of pipes, introducing different grouting agents into each of said independent fluid passage spaces, mixing said different grouting agents just before said fluid discharge means, and discharging the mixed grouting agents from said fluid discharge means.

19. A method according to claim 17 further comprising utilizing said pressurized fluid in said passage space to extend said end tube to said extended position while precluding communication between said passage space and said packer means, and subsequently establishing said communication between said passage space and said packer means after said end tube has reached its extended position.

* * * * *